United States Patent [19]

Rahaim et al.

[11] 4,053,257

[45] Oct. 11, 1977

[54] STATOR VANE ASSEMBLY FOR GAS TURBINES

[75] Inventors: Thomas J. Rahaim, Claymont, Del.; Richard J. Schaller, Allentown, Pa.; Elbert H. Wiley, Jr., Wenonah, N.J.

[73] Assignee: Westinghouse Electric Corporation, Pittsburgh, Pa.

[21] Appl. No.: 659,869

[22] Filed: Feb. 20, 1976

[51] Int. Cl.[2] ..... F04D 29/02

[52] U.S. Cl. ..... 415/214; 415/216; 415/218; 415/219 R

[58] Field of Search ..... 415/216, 217, 218, 219, 415/214; 416/219

[56] References Cited

U.S. PATENT DOCUMENTS

| | | | |
|---|---|---|---|
| 3,784,320 | 1/1974 | Rossmann et al. | 415/214 |
| B 563,412 | 2/1976 | Booher, Jr. et al. | 415/214 |

FOREIGN PATENT DOCUMENTS

| | | | |
|---|---|---|---|
| 1,095,392 | 12/1954 | France | 415/214 |
| 74,794 | 12/1929 | Sweden | 416/219 |
| 301,541 | 11/1954 | Switzerland | 416/219 |
| 335,841 | 10/1930 | United Kingdom | 416/219 |

*Primary Examiner*—C. J. Husar
*Attorney, Agent, or Firm*—F. A. Winans

[57] ABSTRACT

A stator vane assembly is provided, particularly for the first row of stationary vanes of a gas turbine, utilizing ceramic vanes. Each individual vane assembly consists of an airfoil vane with a separate end cap at each end for supporting the vane in position. Each vane has an airfoil portion with a tenon portion at each end thereof having a curved surface for engagement in a recess in the adjacent end cap which has a similarly curved surface. The tenons have a different cross-sectional configuration that the airfoil portions of the vane such that the area of contact between the tenons and the end caps is greater than the cross-sectional area of the airfoil portion and is preferably substantially coextensive with the surface of the recess in the end cap. The tenons terminate short of the leading and trailing edges of the airfoil portion so that the tenons are not coextensive with the airfoil in either direction.

1 Claim, 6 Drawing Figures

STATOR VANE ASSEMBLY FOR GAS TURBINES

BACKGROUND OF THE INVENTION

The present invention relates to gas turbines and, more particularly, to an improved stator vane assembly using ceramic vanes. The invention herein described was made in the course of or under a contract, or subcontract thereunder, with the Department of Defense.

Significant improvements can be made in the efficiency and performance of gas turbines by the use of ceramic elements to permit operation at higher temperatures or with less cooling. In particular, the use of uncooled ceramic stator vanes, especially in the first row of stationary vanes, makes possible a very substantial improvement in efficiency. Because of the mechanical properties of ceramic materials, it has been found that the most desirable construction for such a stator vane assembly involves the use of three-piece vane assemblies in which each airfoil vane is supported by a separate end cap at each end of the vane.

Such a three-piece ceramic vane assembly is disclosed and claimed in a copending application of C. R. Booher, Jr. et al. now U.S. Pat. No. 3,992,127, and assigned to the Assignee of the present invention. As fully discussed in that application, the design of such an assembly must be such that the junction between the airfoil vane and each of the end caps associated with it provides sufficient freedom for the vane to move relative to the end cap as necessary. The design must also be such that the junction between the vane and end cap is capable of supporting the forces applied to the vane which include not only the radial compression forces which retains the vane in position but also the forces due to the gas pressure on the vane and those due to thermal expansion and contraction, while the accurate vane-to-vane alignment in the complete assembly must also be maintained. Steady-state and transient stress concentrations must be minimized because of the sensitivity of ceramic materials to stress concentrations.

The prior application discloses vanes having airfoil portions with extending tenon portions at each end for engagement with the end cap. The tenons have compound curved surfaces for engagement with correspondingly curved surfaces in recesses in the end caps, providing a junction which is capable of meeting the requirements outlined above. In the construction of the prior application, however, the airfoil portion and tenons were of uniform cross section from one end of the vane to the other, so that each tenon was of the same relatively narrow width as the airfoil portion and of the same cross-sectional configuration. This construction resulted in a relatively small area of contact between the tenons and end cap which involved a critical contact problem and relatively high stress concentrations. In addition, it was necessary in the prior design to undercut the trailing edge of the airfoil portion at each end to eliminate the possibility of the trailing edge bottoming out against the end cap during operation. This caused gaps between the airfoil trailing edge and the end caps with a detrimental effect on performance. These problems in the prior three-piece vane assembly resulted in serious limitations on the usefulness of such a design.

SUMMARY OF THE INVENTION

The present invention provides a three-piece ceramic stator vane assembly which avoids the problems and limitations of the prior type of design described above.

In accordance with the invention, each airfoil vane has an airfoil portion with a tenon portion at each end of the airfoil portion for engagement in recesses in the corresponding end caps. The vanes, however, do not have uniform cross section, as in the prior application, and the tenons are formed with a different cross-sectional configuration than that of the airfoil portion. Each tenon has a curved surface, which may be of compound curvature as described in the prior application, for engagement with a correspondingly curved surface in a recess in the end cap. The tenon, however, has a greater cross-sectional area than that of the airfoil portion of the vane such that it extends transversely beyond the airfoil portion on each side to provide a relatively large area of contact between the curved surface of the tenon and the corresponding surface in the end cap recess, the area of contact preferably being substantially coextensive with the curved surface of the recess. In the other or longitudinal direction of the airfoil section, the tenon terminates short of both the leading and trailing edges of the airfoil, so that the tenon is kept away from these regions and the thermal stresses and stress concentrations associated with the prior design are eliminated. The configuration of the tenon, therefore, is such that it extends beyond the airfoil section on both sides in the transverse direction to provide a large area of contact with the end cap but terminates short of the edges of the airfoil section in the longitudinal direction to eliminate the stress problems and possible interference previously encountered. A configuration for a ceramic vane having an airfoil portion with tenons of substantially different cross-sectional configuration at each end is thus provided which avoids the limitations and problems inherent to prior designs.

BRIEF DESCRIPTION OF THE DRAWINGS

The invention will be more fully understood from the following detailed description, taken in connection with the accompanying drawings, in which.

DESCRIPTION OF THE PREFERRED EMBODIMENT

Figure 1:
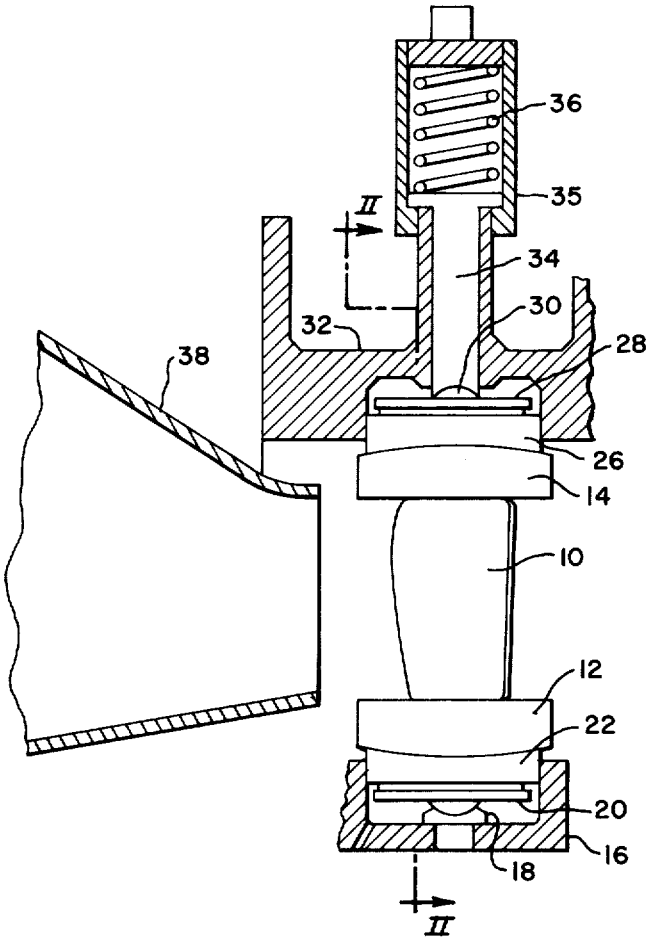
FIG. 1 is a fragmentary longitudinal sectional view of the stator member of a gas turbine showing only the first row of stator vanes.
Figure 2:
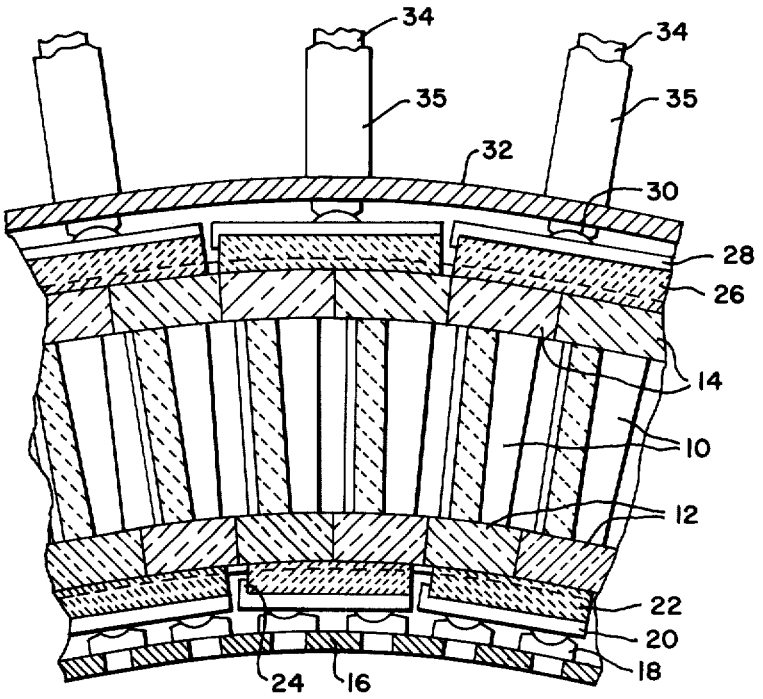
FIG. 2 is a transverse sectional view on the line II—II of FIG. 1.
Figure 5:
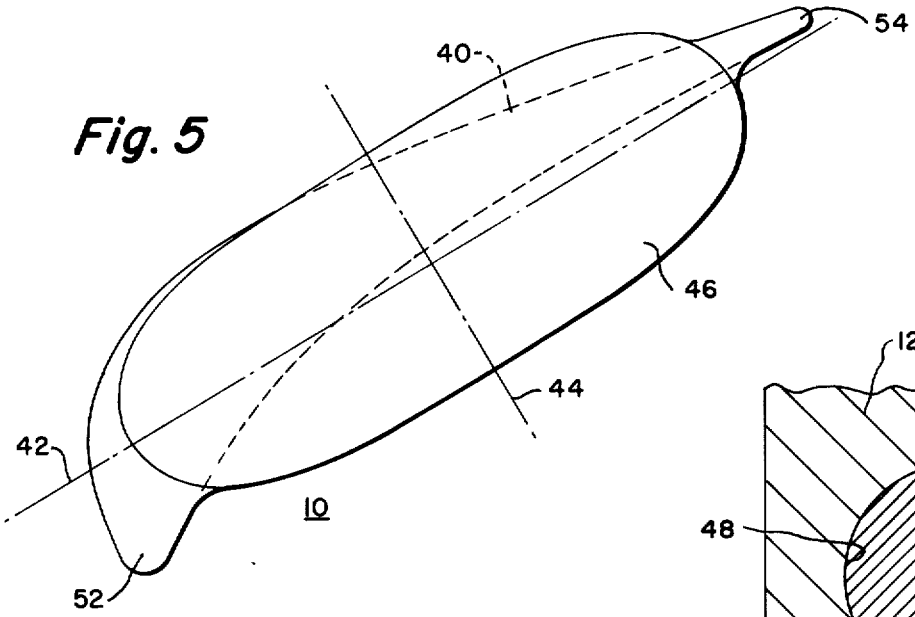
FIG. 5 is a similar view of the opposite end of the vane, looking from the left in FIG. 3.

The invention is shown in the drawings embodied in a stator vane assembly for a gas turbine utilizing ceramic vanes. The assembly is generally of the type shown in the above-mentioned copending application, only the first row of stator vanes being shown although the invention is not necessarily limited to the first row of vanes or to the specific type of assembly shown. The assembly includes a plurality of stator vanes 10, each vane being supported between inner and outer end caps 12 and 14. The vanes 10 are disposed in a circular array, as shown in FIGS. 1 and 2, and the assembly is supported on an inner housing ring 16 which may be of any suitable or usual construction. Inner pivots 18 corresponding in position to the vanes 10 are mounted in any suitable manner in the housing ring 16 and metal shoes 20 carrying corresponding pivot members engage the pivots 18 as shown. An insulator 22 rests on each shoe 20, the shoes having lips 24 engaging the insulators to hold them against circumferential movement. The insulators 22 may be made of any suitable refractory material of low thermal conductivity such as hot-pressed boron nitride, for example. Two inner end caps 12 rest on each insulator 22 and the inner end of a vane 10 is supported on each of the end caps 12.

An outer end cap 14 is disposed at the other end of each vane 10 to support the outer end of the vane. Outer insulators 26, similar to the insulators 22, each engage two of the outer end caps 14. The insulators and the inner and outer end caps are preferably curved in the axial direction of the turbine, as shown in FIG. 1, to prevent axial movement of the end caps. A shoe 28 carrying a pivot 30 engages each of the insulators 26. An outer housing ring 32 of any suitable construction encloses the assembly and carries a plurality of pressure members 34 in suitable housings 35. Each of the pressure members engages one of the outer pivots 30 and is loaded in the radial direction by a compression spring 36 to apply a radial compressive force to the vanes 10 to hold them in position. The assembly so far described is to be taken as representative of any suitable first row stator vane assembly for a gas turbine. In use, hot pressurized gas is directed through transition members 38 from the combustors and is directed by the vanes 10 to the first-stage blades of a rotor (not shown) immediately adjacent the vanes 10. The rotor and other parts of the turbine may be of any usual or desired construction.

The stator vanes 10 and the end caps 12 and 14 are made of a suitable ceramic material such as high-density, hot-pressed silicon nitride or silicon carbide. The three-piece type of vane assembly in which the end caps are separate members from the vane itself, and support the vanes in the complete assembly, is highly advantageous since it permits a design which tends to minimize the component stress with minimum size, and which tends to minimize the amount of machining required which is very expensive with the hard ceramic material. The three-piece design also minimizes the gas load bending stresses in the vane itself and thermal stresses in the junctions with the end caps.

The three-piece design is very desirable for the reasons indicated but it involves certain problems. As more fully discussed in the above-mentioned copending application, the junction between the vane and each end cap must provide sufficient freedom for the necessary relative movement and must be capable of withstanding the forces to which the vane 10 is subjected during operation. In the design of the prior application, the entire vane including both the airfoil portion and the extending end portions or tenons was made of uniform cross section so that the area of contact between the end surfaces of the tenons and the end caps was relatively small, resulting in high stress concentrations and a critical contact problem. In addition, there was a serious possibility of the trailing edge of the airfoil contacting the end caps during operation, which could not be permitted, so that it was necessary to undercut the trailing edge of the airfoil thus introducing a gap between the airfoil trailing edge and the end caps with a detrimental effect on performance.

The use of more advanced methods of stress analysis in designing airfoil vanes has now made it possible to eliminate the requirement of uniform cross section of the vane, and the problems just described can be avoided by the improved design shown in FIGS. 3–6. As there shown, each vane 10 has a central airfoil portion 40. The cross-sectional configuration of this portion of the vane may be of usual airfoil shape determined for optimum performance and may vary as required from one end of the vane to the other. The airfoil cross section has a longitudinal axis indicated at 42 and a transverse axis indicated at 44. The airfoil portion 40 of the vane is joined at each end by an integral extending tenon portion 46. Each tenon 46 has a curved surface for engagement in a recess 48 in the corresponding end cap. The engaging surfaces of the tenon and of the end cap are preferably compound curved surfaces such as are disclosed in the abovementioned copending application, and are preferably toroidal surfaces. That is, each tenon 46 has a surface which is circularly curved in the longitudinal direction 42 of the airfoil portion with a relatively large major radius of curvature, and which is also circularly curved in the transverse direction 44 with a smaller minor radius of curvature. The corresponding surfaces of the recesses 48 of the end caps are similarly curved, with slightly larger radii of curvature, to be engaged by the tenons.

Figure 6:
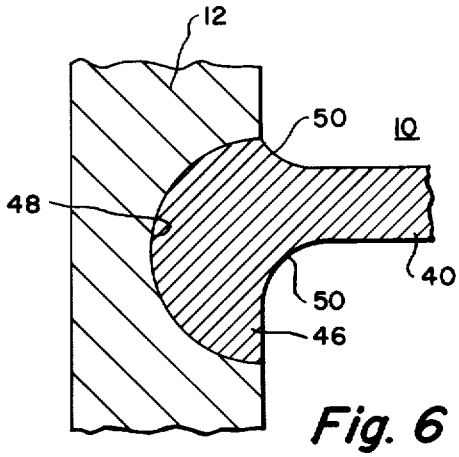
FIG. 6 is a fragmentary sectional view substantially on the line VI—VI of FIG. 4.
Figure 4:
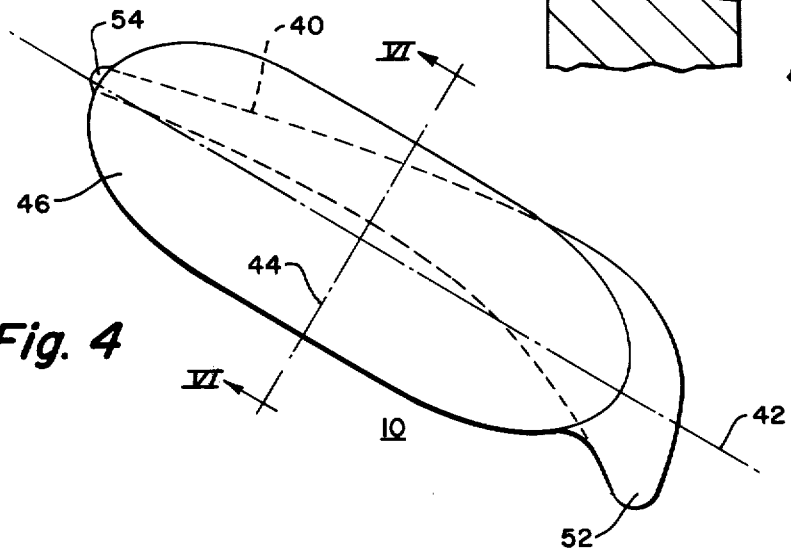
FIG. 4 is a plan view of one end of a vane embodying the invention, looking from the right in FIG. 3.

In accordance with the invention, the tenons 46 are of different cross-sectional configuration than the airfoil portion 40 of the vane. As can be seen in FIG. 6, the tenon 46 is substantially wider than the airfoil portion 40 in the transverse direction so that it overhangs the airfoil portion on both sides, although for different distances, the maximum width of the tenon being substantially the same as that of the recess 48. The tenon 46 is joined to the airfoil portion 40 by a curved transition region 50 at each side which is contoured so as to minimize the rate of change of the area and avoid undesirable stress concentrations. The tenons 46 are also proportioned so that they terminate short of the leading edge 52 of the airfoil portion as can be clearly seen in the opposite end views of FIGS. 4 and 5. The extent of the airfoil portion is such that it extends longitudinally beyond the tenon 46, especially at the radially outer end (FIG. 5), so that the tenons also terminate short of the trailing edge 54 at both ends. Thus, the tenon 46 only partially covers the cross-sectional extent of the airfoil portion 40 of the vane and does not interact with the highly stressed areas at the leading and trailing edges of the airfoil portion, as well as avoiding the undercutting which was previously necessary. In this way, the thermal stresses induced by changing area and any stress concentration associated with the radius between the airfoil and tenon are eliminated.

Figure 3:
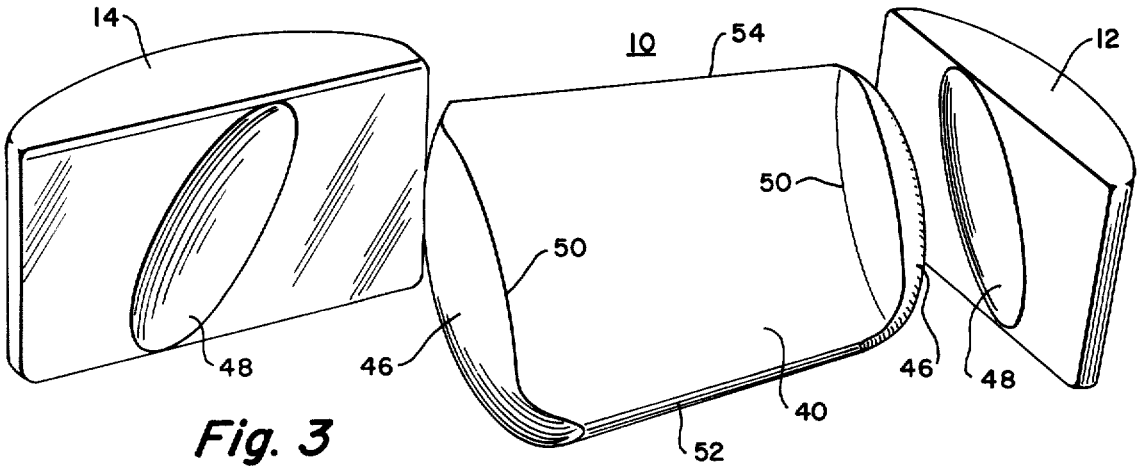
FIG. 3 is an exploded perspective view of a ceramic vane assembly embodying the invention.

It will be seen that by making the tenon of substantially greater width than that required for the airfoil section itself, and by making it of less longitudinal extent than the airfoil section so as to terminate short of the leading and trailing edges, the tenon has a cross-sectional configuration substantially different from that of the airfoil section. Preferably, the width of the tenon is made such that the area of contact between the curved outer surface of each tenon 46 and the corresponding curved surface in the end cap recess 48 is substantially coextensive with the surface of the recess, as can be seen in FIGS. 3 and 6. A large area of contact is thus maintained between the vane and the end cap which eliminates the critical contact problem of previous designs by greatly reducing the unit stress in the contact area. The compound curved engaging surfaces of the tenon and end cap, however, still permit the necessary freedom of relative movement between the end caps and the vane and are capable of supporting the forces to which the vane is subjected in use.

It should now be apparent that a three-piece design has been provided for ceramic stator vanes which eliminates the problems involved in this type of design. The specific configurations shown and described for the purpose of illustration are, of course, only illustrative and it will be understood that the airfoil portion of the vane may be designed for optimum performance without regard to the tenons while the tenon portions may be designed in the manner described above to provide the maximum area of contact without incurring the problems and limitations of prior designs.

What is claimed is:

1. An improved turbine stator vane assembly having ceramic components comprising a vane member disposed between, and in compressive intimate contact with, opposed end caps, wherein the inner surface of each of said end caps contains a groove for receipt of the respective end of the vane member providing pivot and seat interengaging surfaces, each of said grooves defining a compound arcuate surface having a major radius of curvature in a plane substantially parallel to the plane of the longitudinal direction of the vane and a minor radius of curvature in a plane perpendicular to the plane of the major radius wherein the improvement comprises:

said vane member defining an airfoil portion terminating at radially opposed ends in integral tenon portions having an outer surface conforming to the arcuate configuration of said groove for intimate substantially coextensive contact therebetween; and, wherein the inner surface of said tenon portion is generally flush with the inner surface of said end cap when in the assembled position;

whereby, the tenon portion of the vane member fills the groove in the end cap providing a continuous smooth surface for non-turbulent fluid flow thereacross and wherein the configuration of the tenon further provides a cross-sectional area in the tenon relating to the immediately adjacent thickness of the airfoil portion such that the largest cross-sectional area of the tenon is adjacent the thickest portion of the airfoil portion for general equal rates of heating and cooling of said adjacent portions to minimize thermal gradients with attendant thermal stresses at their juncture.

* * * * *